US005979819A

United States Patent [19]

Locatelli

[11] Patent Number: 5,979,819

[45] Date of Patent: Nov. 9, 1999

[54] MACHINE FOR THE FORMATION OF ROLLS OF COTTON-WOOL IN COMPACT FORM

[75] Inventor: Achille Locatelli, Torno, Italy

[73] Assignee: Freudenberg Politex, s.r.l., Milan, Italy

[21] Appl. No.: 09/077,851

[22] PCT Filed: Nov. 29, 1996

[86] PCT No.: PCT/EP96/05368

§ 371 Date: Jun. 4, 1998

§ 102(e) Date: Jun. 4, 1998

[87] PCT Pub. No.: WO97/22519

PCT Pub. Date: Jun. 26, 1997

[30] Foreign Application Priority Data

Dec. 4, 1995 [IT] Italy ..... MI95A2537

[51] Int. Cl.[6] ..... B65H 18/08

[52] U.S. Cl. ..... 242/530.2; 242/533; 242/541.3

[58] Field of Search ..... 242/530.2, 533, 242/533.1, 541.3; 53/118; 100/5, 40, 76, 87, 88

[56] References Cited

U.S. PATENT DOCUMENTS

| | | | |
|---|---|---|---|
| 546,009 | 9/1895 | Graves | 242/541.3 |
| 1,772,164 | 8/1930 | Taft | 242/541.3 |
| 2,157,765 | 5/1939 | Lanter | 242/541.3 |
| 2,372,856 | 4/1945 | Saunders | 100/87 |
| 2,743,065 | 4/1956 | Watkins | 242/541.3 |
| 4,034,928 | 7/1977 | McDonald et al. | 242/541.3 |
| 4,114,530 | 9/1978 | Miller . | |
| 4,146,188 | 3/1979 | Hewinson et al. | 242/541.3 |
| 4,184,648 | 1/1980 | Mergell | 242/533 |
| 5,381,982 | 1/1995 | Adamski | 242/541.3 |
| 5,425,512 | 6/1995 | Bichot et al. | 242/541.3 |
| 5,832,696 | 11/1998 | Nagy et al. | 242/541.3 |

FOREIGN PATENT DOCUMENTS

| | | |
|---|---|---|
| 1.438.851 | 4/1966 | France . |
| 2 095 203 | 9/1982 | United Kingdom . |

*Primary Examiner*—Donald P. Walsh
*Assistant Examiner*—William A. Rivera
*Attorney, Agent, or Firm*—Millen, White, Zelano & Branigan

[57] ABSTRACT

A machine for the formation of rolls of cotton-wool in compact form comprises a closed-loop conveyor belt having a horizontal upper branch on which there is placed a layer of cotton-wool to be wound. The machine includes a pair of support rollers for the horizontal upper branch, a first operator to execute displacement of the support rollers from a rest position with rollers reciprocally distanced to a working position with rollers reciprocally close to one another, the rollers passing through an intermediate position of partial reciprocal closeness. A support for a freely-rotatable core destined for winding up the cotton-wool and second operator that can be operated after the displacement of said support rollers in said position of partial reciprocal closeness to execute descent of the support of the core from a rest position above the upper branch of the conveyor belt to a position of partial lowering below the upper branch of the conveyor belt. The core engages and lowers a portion of the upper branch of the conveyor belt and a corresponding portion of the layer of cotton-wool passing between the support rollers so as to create a loop of the upper branch and the support rollers. A third operator driving the conveyor belt winds up the layer of cotton-wool around the core after a further displacement of the support rollers in said working position and while the descent of the core continues. Tensioners associated with the conveyor belt maintain tension of the belt at a constant value suitable for pressing the cotton-wool as the core continues to move downward and as the cotton-wool is wound on the core itself.

4 Claims, 5 Drawing Sheets

MACHINE FOR THE FORMATION OF ROLLS OF COTTON-WOOL IN COMPACT FORM

The present invention relates to a machine for the formation of rolls of cotton-wool in compact form.

The machines of this type are also known under the name of cotton-wool compactors and have the task of packaging the cotton-wool in rolls of the most limited dimensions possible in view of their transport from the manufacturing plant to the place of usage.

In known compactors of cotton-wool a layer of cotton-wool of normal thickness obtained at the end of the process is wound on a support core, so as to form a roll of large dimensions that is subsequently introduced in an outer sheath of polyethylene. The whole is then subjected to a reduction of transversal size by means of the diametric contraction of a cage of parallel rods placed round the wound roll and/or by extraction of air from the inside of the sheath.

The result is a roll of reduced dimensions but with an irregular shape with the outer coating creased and partially deteriorated, that once returned to the original dimensions gives rise to a finished product that cannot be defined perfect.

In view of this state of the art, the object of the present invention has been that of providing a machine that allows the formation of rolls of cotton-wool with minimum dimensions, perfectly cylindrical and with the outer coating absolutely intact.

According to the invention such object has been achieved with a machine characterized in that it comprises a closed-loop conveyor belt having a horizontal upper branch on which there is placed a layer of cotton-wool to be wound, a pair of support rollers for said horizontal upper branch, first operating means to execute the displacement of said support rollers from a rest position with rollers reciprocally distanced to a working position with rollers reciprocally close to one another passing through an intermediate position of partial reciprocal closeness, support means for a freely-rotatable core destined for winding up the cotton-wool, second operating means that can be operated after the displacement of said support rollers in said position of partial reciprocal closeness to execute the descent of said support means of the core from a rest position above said upper branch of the conveyor belt to a position of partial lowering below said upper branch of the conveyor belt wherein the core has engaged and lowered a portion of said upper branch of the conveyor belt and a corresponding portion of the layer of cotton-wool passing between said support rollers so as to create a loop of said upper branch of the conveyor belt and of the layer of cotton-wool below said upper branch and said support rollers, third operating means to drive said conveyor belt to wind up the layer of cotton-wool round said core after a further displacement of said support rollers in said working position and while the descent of the core continues, and tensioning means associated with the conveyor belt to maintain the tension of the belt at a constant value suitable for pressing the cotton-wool as the core continues to move downward and the cotton-wool is wound on the core itself.

A protective film of flexible material is preferably supplied on a terminal section of the layer of cotton-wool to be wound by the same machine round the roll of cotton-wool and then sealed so as to maintain the latter in a wound-up and compact condition when the roll itself has reached predetermined final dimensions and before said third operating means stop and said first and second operating means move in reverse to return said support rollers and said support means of the core to a rest position.

In this way the constant-tension conveyor belt winds the cotton-wool progressively round the supporting core and at the same time it reduces its thickness, obtaining at the end a perfectly cylindrical roll already compacted and wound in a protective sheath, that needs no further treatments. The external coating of the roll thus formed is perfect, just as the finished product is free of all defects when, after transport, it is unwound and returned to the original dimensions by a suitable treatment, for example in a machine like that described in the European patent application No. 0674034 by the same Applicant.

The features and advantages of the present invention will now be made more evident by the following detailed description of an embodiment thereof illustrated as a non-limiting example in the enclosed drawings, wherein.

Figure 1:
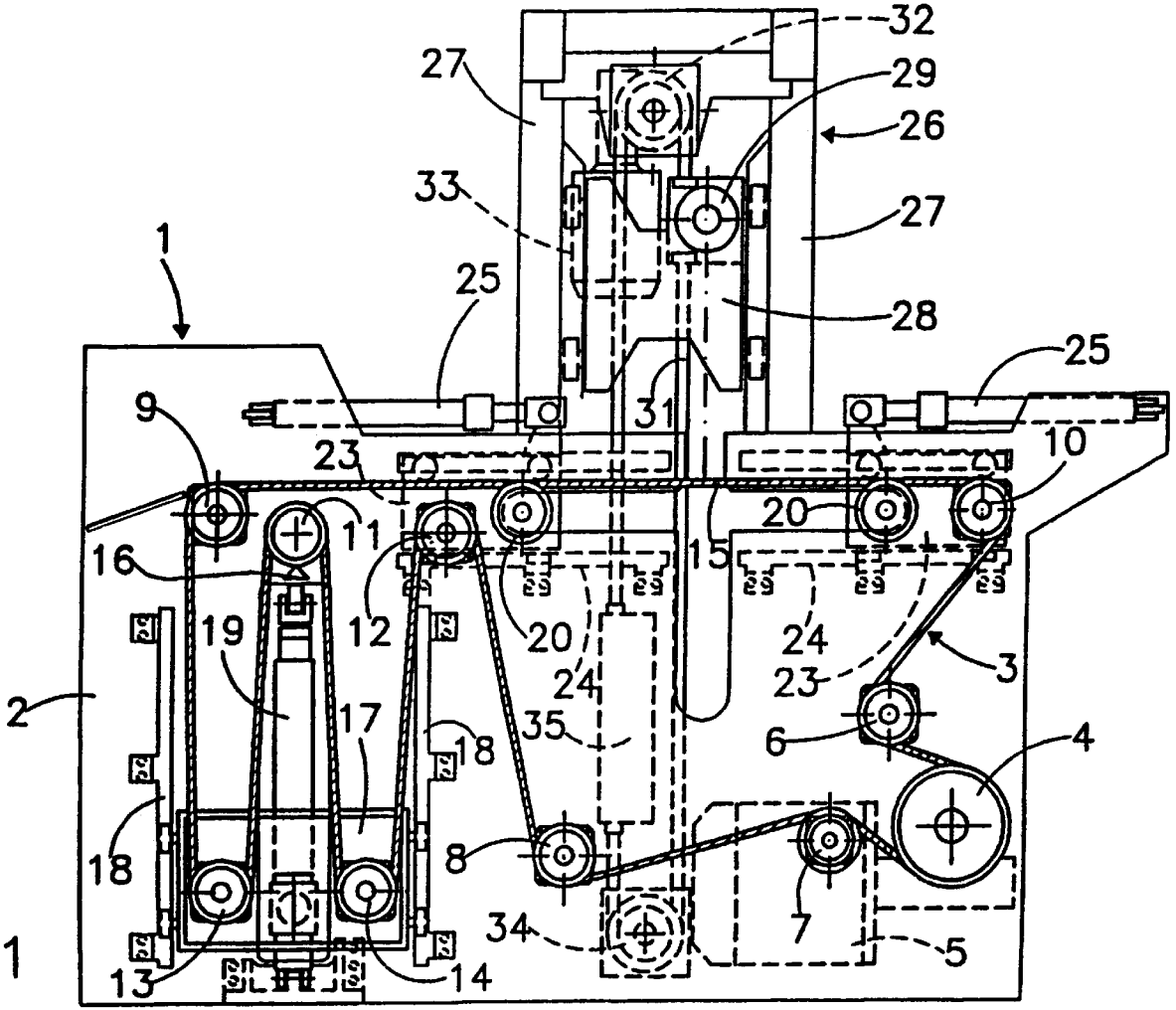
FIG. 1 shows an elevated view of a machine according to the invention in a condition at rest.

The machine illustrated in the drawings comprises a base part I comprising a supporting chassis 2 for a series of driving, support and transmission rollers for a closed-loop conveyor belt 3, for example in PVC with trapeze-shaped lateral guides.

As shown in particular in FIG. 1, a first roller 4 constitutes a driving roller for the conveyor belt 3 and receives motion from a variable-speed motor 5. All the other rollers 6–14 in engagement with the conveyor belt 3 are idle and in particular the rollers 6–8 are simple transmission rollers, the rollers 9 and 10 define a horizontal upper branch 15 of the belt 3 and the rollers 11 and 12 co-operate with a pair of load cells 16 (one for each side of the machine) placed under the roller 11 and with a pair of tensioning rollers 13 and 14 in step one with the other, supported by a pair of slides 17 (one for each side of the machine, as shown in FIG. 2) movable along vertical guides 18 under the action of a pair of hydraulic cylinders 19, to define a device for tensioning the belt suitable for maintaining the belt itself at a constant tension, as will be better seen later.

With the upper branch 15 of the conveyor belt 3 there are also in engagement two support rollers 20, that have their ends endowed with pinions 21 in step-engagement with respective toothed racks 22 (FIG. 2) and are rotatably supported by respective slides 23 movable along horizontal guides 24 under the action of respective hydraulic cylinders 25 (FIG. 1). For the sake of accuracy, the support rollers 20 are displaceable from the rest position and greatest reciprocal distance of FIG. 1 to the working position and greatest reciprocal closeness of FIGS. 4 and 5, passing through an intermediate position of partial reciprocal closeness that is shown in FIG. 3.

Above the base part 1, in a position intermediate between the support rollers 20 in the rest position, there is arranged a head part 26 (FIGS. 1 and 2), that comprises a pair of pillars 27 suitable for acting as guides for a pair of slides 28 moving vertically, that carry respective idle chucks 29 destined for supporting respective ends of a core 30 in turn destined for supporting the roll of cotton-wool to be formed. The two slides 28 are attached to respective belts 31, that extend in a closed ring between an upper pulley 32 endowed with a motor 33 and a lower idle pulley 34 and they also carry a counterweight 35.

Figure 2:
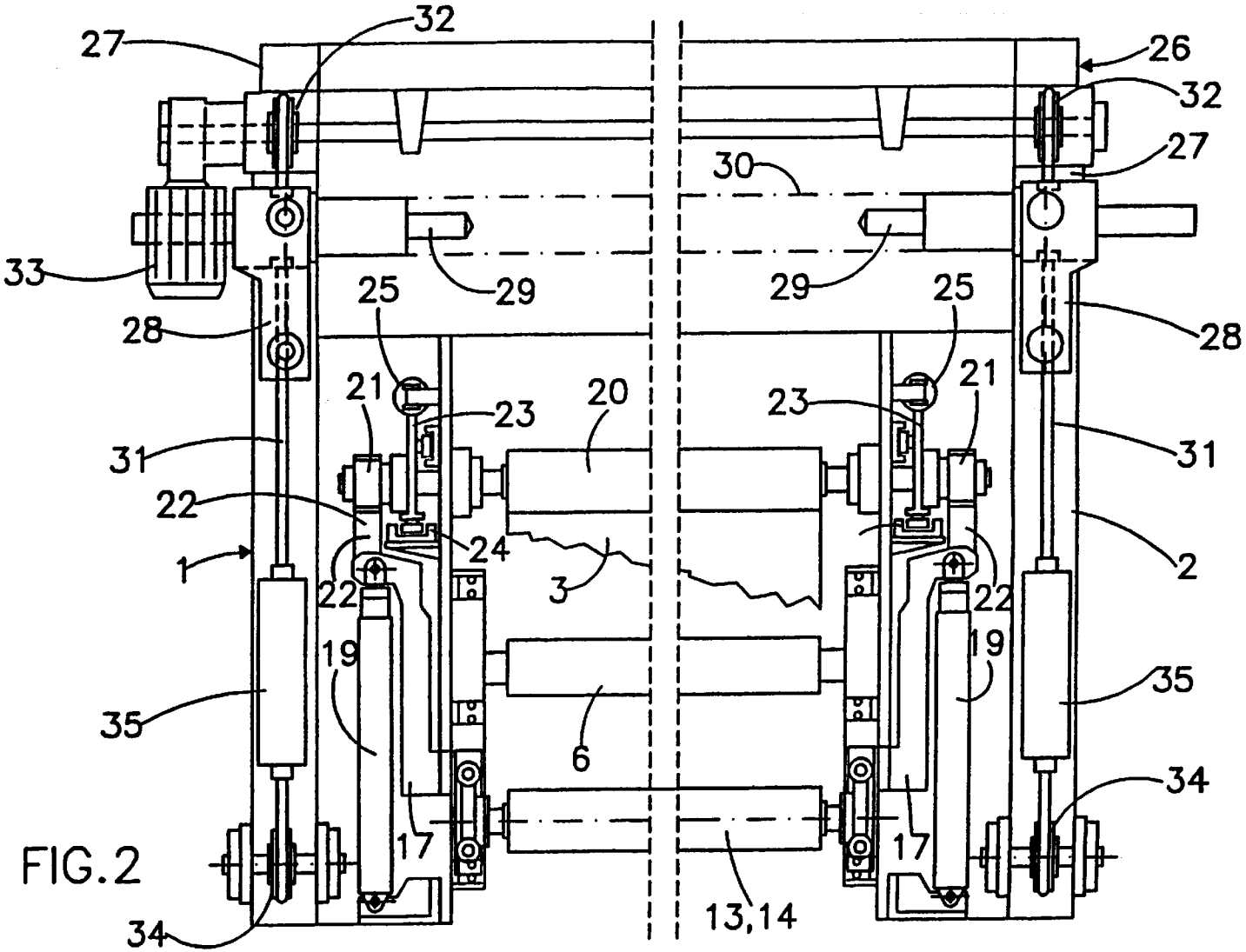
FIG. 2 shows the machine in a side view, again in a condition at rest.
Figure 3:
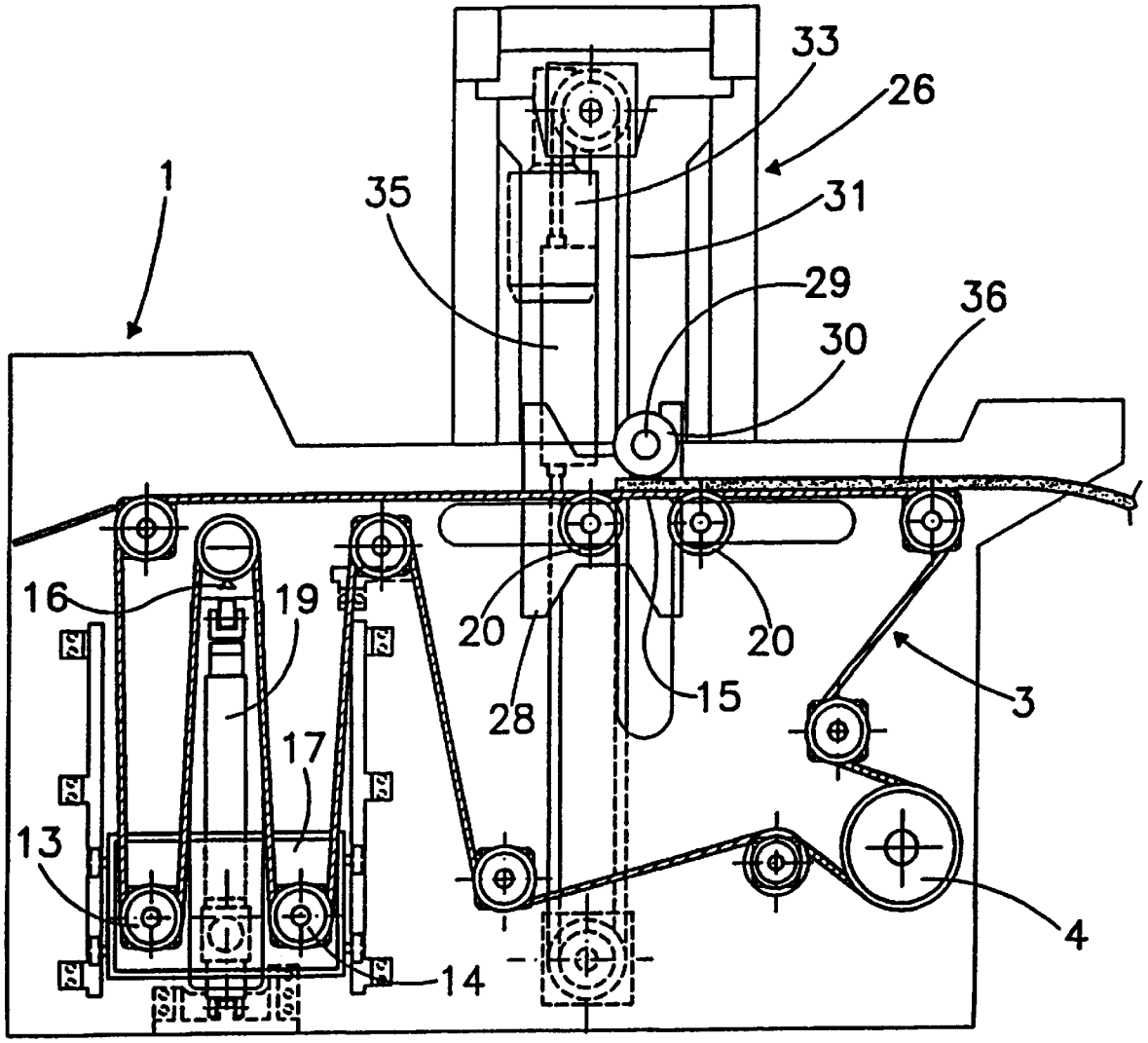
FIG. 3 shows the machine again in elevation, during an initial step of its working cycle.

In operation, with the machine in the condition at rest of FIGS. 1 and 2, a cardboard core 30 is loaded between the chucks 29 and a layer of cotton-wool 36 to be wound round the core 30 is introduced on the horizontal upper branch 15, as shown in FIG. 3.

The cylinders 25 are then driven to perform the displacement of the support rollers 20 from the rest position of FIG. 1 to the partial closeness position of FIG. 3, where between the two rollers 20 there remains only space sufficient for the passage of the two chucks 29 with the corresponding core 30, whose descent under the action of the motor 33 has in the meantime begun.

Figure 4:
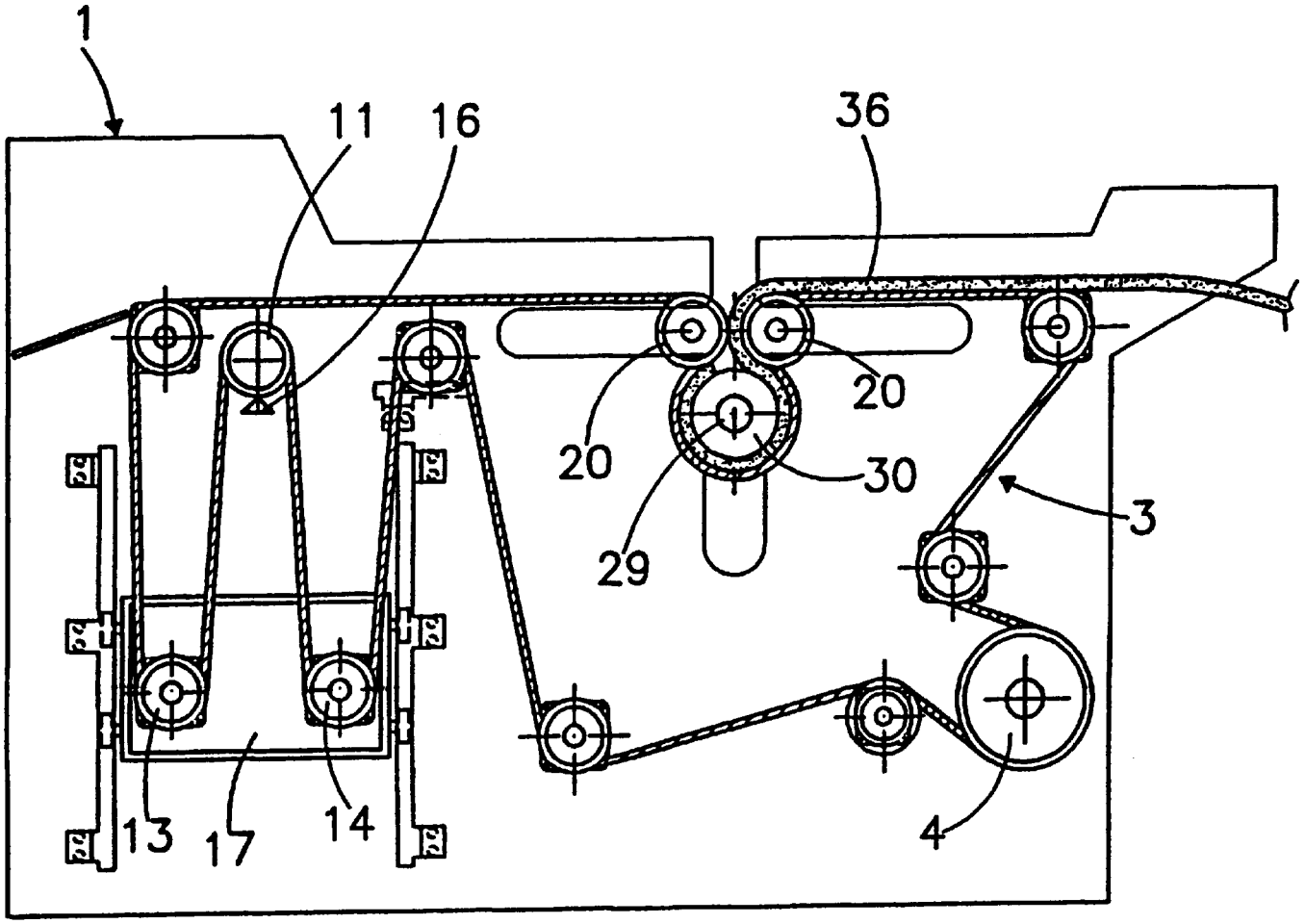
FIGS. 4 and 5 show a base part of the machine, again in elevation, during successive steps of its working cycle.
Figure 5:
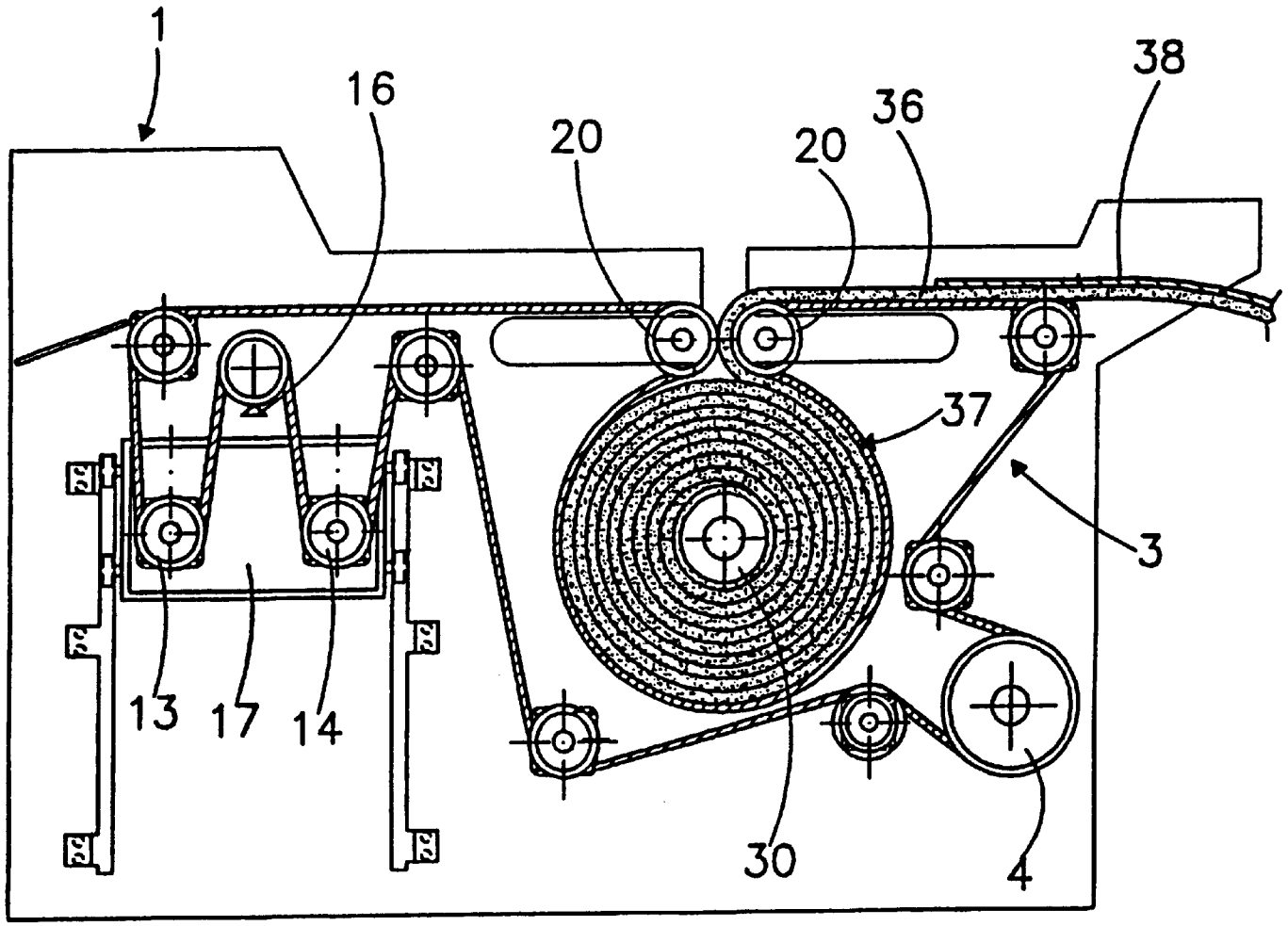

When the core 30 meets the initial section of the layer of cotton-wool 36 that is superimposed over the upper section 15 of the conveyor belt 3 above the space defined between the rollers 20, and then continues its descent, the core itself moves downward both the cotton-wool and the conveyor belt, thus determining the partial winding of the layer of cotton-wool round the core itself and the formation of a loop of the conveyor belt, as shown in FIG. 4.

The rollers 20 are then displaced to the working position and greatest closeness of FIG. 4 and the load cells 16, detecting through the roller 11 an increase in the tension of the conveyor belt 3, execute through the cylinders 19 a partial ascent of the slides 17 with the corresponding tensioning rollers 13 and 14 in order to re-establish the desired tension of the belt.

Simultaneously with the attainment of the position of greatest closeness on the part of the support rollers 20, the motor 5 executes through the driving pulley 4 the operation of the conveyor belt 3, that together with the further descent of the two chucks 29 and of the corresponding core 30 determines the progressive winding of the layer of cotton-wool 36 round the core 30. In the meantime the tensioning device consisting of the load cells 16, of the cylinders 19, of the slides 17 and of the tensioning rollers 13 and 14 maintains the tension of the conveyor belt 3 at a constant value suitable for ensuring the winding of the cotton-wool with a minimum thickness but without deteriorating the cotton-wool itself.

Round the core 30 there is thus formed a roll of cotton-wool 37 (FIG. 5), whose final dimensions are fixed, for example, by means of an encoder associated with the motor 33 used to move the chucks 29 downward.

Just before the attainment of the abovementioned final dimensions of the roll 37, a film 38 of polyethylene or other suitable flexible plastic material for packaging is superimposed over the terminal section of the layer of cotton-wool 36 so as to be wound round the roll 37 and thus form a protective sheath for the roll itself, that is lastly sealed by means of the application of a suitable glue (in a manner not shown but known in itself).

At that point the cylinders 25 drive the support rollers 20 back to their rest position and immediately afterward the motor 33 executes the return ascent of the chucks 29 with the corresponding core 30 and roll 37 wound in the film 38.

The cycle of the machine is thus over and a packed roll 37 is thus obtained, that is perfectly cylindrical, with a suitably reduced diameter and with the surface absolutely perfect. Further processes before transport are not necessary and, once the place of usage has been reached, the cotton-wool can be removed from the protective sheath, unwound and returned with no defects to the original thickness, for example through the machine described in the European patent application No. 0674034 of the same Applicant.

I claim:

1. A machine for the formation of rolls of cotton-wool in compact form, characterized in that it comprises a closed-loop conveyor belt (3) having a horizontal upper branch (15) on which there is placed a layer of cotton-wool (36) to be wound, a pair of support rollers (20) for said horizontal upper branch (15), first operating means (25) to execute the displacement of said support rollers (20) from a rest position with rollers reciprocally distanced to a working position with rollers reciprocally close to one another passing through an intermediate position of partial reciprocal closeness, support means (29) for a freely-rotatable core (30) destined for winding up the cotton-wool, second operating means (33) that can be operated after the displacement of said support rollers (20) in said position of partial reciprocal closeness to execute the descent of said support means (29) of the core (30) from a rest position above said upper branch (15) of the conveyor belt (3) to a position of partial lowering below said upper branch (15) of the conveyor belt (3) wherein the core (30) has engaged and lowered a portion of said upper branch (15) of the conveyor belt (3) and a corresponding portion of the layer of cotton-wool (36) passing between said support rollers (20) so as to create a loop of said upper branch of the conveyor belt and of the layer of cotton-wool below said upper branch (15) and said support rollers (20), third operating means (5) to drive said conveyor belt (3) to wind up the layer of cotton-wool (36) round said core (30) after a further displacement of said support rollers (20) in said working position and while the descent of the core (30) continues, and tensioning means (13, 14, 16, 17, 19) associated with the conveyor belt (3) to maintain the tension of the belt at a constant value suitable for pressing the cotton-wool as the core (30) continues to move downward and the cotton-wool (36) is wound on the core itself.

2. A machine according to claim 1, characterized in that a protective film (38) of flexible material is supplied on a terminal section of said layer of cotton-wool (36) to provide through the forward movement of the belt (3) the winding of the same film round the roll of cotton-wool (37) and then to proceed to its sealing to maintain the roll itself in a wound-up and compact condition after having reached predetermined final dimensions and before said third control means (5) stop and said first and second operating means (25, 33) move in reverse to return said support rollers (20) and said support means (29) of the core (30) to a rest position.

3. A machine according to claim 1, characterized in that it comprises pinion and toothed rack means (21, 22) associated with said support rollers (20) to maintain the latter in step one with the other during their displacement from the rest position to the working position.

4. A machine according to claim 1, characterized in that said tensioning means (13, 14, 16, 17, 19) of the conveyor belt (3) comprise a pair of tensioning rollers (13, 14) rotatably mounted on a pair of slides (17) to reduce the path of the belt outside said loop as the formation of the roll of cotton-wool (37) proceeds, a pair of load cells (16) associated with an idle roller (11) of the conveyor belt (3) to detect the increases in the tension of the belt caused by the progressive increment of the dimensions of the roll of cotton-wool and a pair of hydraulic cylinders (19) to cause the displacement of said slides (17) under the action of said load cells (16).

* * * * *